US005890109A

United States Patent [19]

Walker et al.

[11] Patent Number: 5,890,109

[45] Date of Patent: Mar. 30, 1999

[54] RE-INITIALIZING ADAPTIVE PARAMETERS FOR ENCODING AUDIO SIGNALS

[75] Inventors: Mark R. Walker, Beaverton; Jeffrey Kidder, Hillsboro; Michael Keith, Portland, all of Oreg.

[73] Assignee: Intel Corporation, Santa Clara, Calif.

[21] Appl. No.: 623,264

[22] Filed: Mar. 28, 1996

[51] Int. Cl.[6] ..... G10L 3/02

[52] U.S. Cl. ..... 704/215; 704/233; 704/500

[58] Field of Search ..... 395/2.91, 2.19, 395/2.24, 2.42, 2.17, 2.09, 2.1, 2.16, 2.23, 2.33, 2.39; 704/500, 210, 215, 233, 208, 200, 201, 207, 214, 224, 230

[56] References Cited

U.S. PATENT DOCUMENTS

| | | | |
|---|---|---|---|
| 4,412,066 | 10/1983 | Ahmed | 395/2.42 |
| 4,449,190 | 5/1984 | Flannagan et al. | 395/21 |
| 4,704,730 | 11/1987 | Turner et al. | 395/2.19 |
| 4,893,197 | 1/1990 | Howells et al. | 360/8 |
| 5,438,643 | 8/1995 | Akagiri et al. | 395/2.91 |

OTHER PUBLICATIONS

"Real–Time Implementation and Evaluation of an Adaptive Silence Deletion Algorithm for Speech Compression," by Chris Rose and Dr. Robert W. Donaldson, IEEE Pacific Rim Conference on Communications, Computers and Signal Processing, May 9–10, 1991, pp. 461–468.

"The Voice Activity Detector for the Pan–European Digital Cellular Mobile Telephone Service," by D.K. Freeman, G. Cosier, C.B. Southcott, and I. Boyd, British Telecom Research Labs. Speech and Language Processing Division, Martlescham Health, Ipswich, England, 1989 IEEE, pp. 369–372.

"Voiced–Unvoiced–Silence Detection Using the Itakura LPC Distance Measure," by L.R. Rabiner and M.R. Sambur, 1977 IEEE International Conference on Acoustics, Speech & Signal Processing at the Sheraton–Hartford Hotel, Hartford, CT, May 9–11, 1977, pp. 323–326.

"Speech and Silence Discrimination Based on ADPCM Signals," by S.N. Koh and N.K. Lim, Journal of Electrical Engineering, Australia—IE Aust & IREE Aust. vol. 11, No. 4, Dec. 1991, pp. 245–248.

"Voiced–Unvoiced–Silence Classification of Speech Signals Based on Statistical Approaches," by B.A.R. Al–Hashemy and S.M.R. Taha, Applied Acoustics 25 1988 Elsevier Science Publishers Ltd. England, pp. 169–179.

"A Fast Neural Net Training Algorithm and Its Application to Voiced–Unvoiced–Silence Classification of Speech," by Thea Ghiselli–Crippa, Amro El–Jaroudi, 1991 IEEE, pp. 441–444.

"Fast Endpoint Detection Algorithm for Isolated Word Recognition in Office Environment," by Evangelos S. Dermatas, Nikos D. Fakotakis, and George K. Kokkinakis, 1991 IEEE, pp. 733–736.

"Silent and Voiced/Unvoiced/Mixed Excitation (Four–Way) Classification of Speech," by D.G. Childers, M. Hahn, and J.N. Larar, IEEE Transactions on Acoustics, Speech, and Signal Processing, vol. 37, No. 11, Nov. 1989, pp. 1771–1774.

Comments on "An Improved Endpoint Detector for Isolated Word Recognition," by Ben Reaves, IEEE Transacitons on Signal Processing, vol. 39 No. 2, Feb. 1991, pp. 526–527.

(List continued on next page.)

*Primary Examiner*—Richemond Dorvil

*Attorney, Agent, or Firm*—William H. Murray; N. Stephan Kinsella

[57] ABSTRACT

One or more dynamically updated measures are generated for an audio stream. Processing is performed using the measures to distinguish silent periods from non-silent periods in the audio stream and the audio stream is encoded, wherein the silent periods are encoded differently from the non-silent periods. The processing is re-initialized during the encoding of the audio stream, if certain conditions are met. In a preferred embodiment, the processing is re-initialized if either of the following two conditions is met: (1) one of the non-silent periods is longer than a duration threshold or (2) an energy measure for the silent periods of the audio stream exceeds an energy threshold level.

32 Claims, 6 Drawing Sheets

OTHER PUBLICATIONS

"An Improved Endpoint Detector for Isolated Word Recognition," by Lori F. Lamel, Lawrence R. Rabiner, Aaron E. Rosenberg and Jay G. Wilpon, IEEE Transaction on Acoustics, Speech, and Signal Processing, vol ASSP–29, No. 4, Aug. 1981, pp. 777–785.

"Voiced/Unvoiced/Mixed Excitation Classification of Speech," by Leah J. Siegel and Alan C. Bessey, IEEE Transactions on Acoustics, Speech, and Signal Processing, vol. ASSP–30, No. 3, Jun. 1982, pp. 451–460.

"Voice Activity Detection Using a Periodicity Measure," by R. Tucker, IEE Proceedings–1, vol. 139, No. 4, Aug. 1992, pp. 377–380.

"Application of an LPC Distance Measure to the Voiced–Unvoiced–Silence Detection Problem," by Lawrence R. Rabiner and Marvin R. Sambur, IEEE Transaction on Acoustics, Speech, and Signal Processing, vol. ASSP–25, No. 4, Aug. 1977, pp. 338–343.

"A Pattern Recognition Approach to Voiced–Unvoiced–Silence Classification with Applications to Speech Recognition," by Bishnu S. Atal and Lawrence R. Rabiner, IEEE Transacitons on Acoustics, speech, and Signal Processing, vol. ASSP–24, No. 3, Jun. 1976, pp. 201–212.

"Multimedia Conferencing in the Etherphone Enviornment," by Harrick M. Vin, Polle T. Zellweger, Daniel C. Swinehart, P. Venkat Rangan, Xerox Palo Alto Research Center, Oct. 1991 IEEE, pp. 69–79.

"Linear Prediction: A Tuturial Review," by John Makhoul, Proceedings of the IEEE, vol. 63, No. 4, Apr. 1975, pp. 561–580.

Gan, C. and Donaldson, "Adaptive Silence Deletion for Speech Storage and Voice Mail Applications", *IEEE Tranactions on Acoustics, Speech, and Signal Processing* Jun. 1988, 36(6), 924–927.

Southcott, C.B. et al, "Voice Control of the Pan–European Digital Mobile Radio System", *Communications Technology for the 1990's and Beyond, Institue of Electrical and Electronics Engineers,* Nov. 27–30, 1989, vol. 2 of 3, 1070–1074.

FIG. 1. POINT-TO-POINT CONFERENCING NETWORK

FIG. 2. AUDIO ENCODING

FIG. 3. AUDIO DECODING

RE-INITIALIZING ADAPTIVE PARAMETERS FOR ENCODING AUDIO SIGNALS

BACKGROUND OF THE INVENTION

1. Field of the Invention

The present invention relates to digital audio processing, and, in particular, to the detection and encoding of silent periods during speech coding.

2. Description of the Related Art

It is known in the art to compress digital audio signals for more efficient transmission and/or storage. Speech coding refers to the compression of digital audio signals corresponding to human speech. Speech coding may be applied in a variety of situations. For example, speech coding may be used in audio conferencing between two or more remotely located participants to compress the audio signals from each participant for efficient transmission to the other participants. Speech coding may also be used in other situations to compress audio streams for efficient storage for future playback.

It is also known in the art to distinguish between periods of silence and periods of non-silence during speech coding. Those skilled in the art understand that the term "silence" refers to period in which there is no speech. In fact, the audio environment may have significant levels of background noise. As a result, silent periods typically are not really silent at all. Various schemes have been proposed for determining which sequences of digital audio signals correspond to speech (i.e., non-silent periods) and which sequences correspond to silence (i.e., silent periods).

Traditionally, digital audio processing such as speech coding has been performed on specially designed digital signal processing (DSP) chips. These DSP chips are specifically designed to handle the high processing loads involved in digital audio processing. As general-purpose processors become faster and more powerful, it is becoming possible to shift more and more of such digital audio processing from DSPs to general-purpose processors. What is needed is efficient algorithms for implementing digital audio processing in "software" on general-purpose processors rather than in "hardware" on DSPs.

Further objects and advantages of this invention will become apparent from the detailed description of a preferred embodiment which follows.

SUMMARY OF THE INVENTION

This invention is directed to the encoding of audio signals. According to one embodiment, one or more dynamically updated measures are generated for an audio stream. Processing is performed using the measures to distinguish silent periods from non-silent periods in the audio stream and the audio stream is encoded, wherein the silent periods are encoded differently from the non-silent periods. The processing is re-initialized during the encoding of the audio stream, if certain conditions are met.

BRIEF DESCRIPTION OF THE DRAWINGS

Other objects, features, and advantages of the present invention will become more fully apparent from the following detailed description of the preferred embodiment, the appended claims, and the accompanying drawings in which:

DESCRIPTION OF THE PREFERRED EMBODIMENT(S)

The present invention is related to the encoding of audio signals corresponding to human speech, where the audio stream is analyzed to distinguish between periods with speech (i.e., non-silent frames) and periods without speech (i.e., silent frames).

System Hardware Architectures

Figure 1:
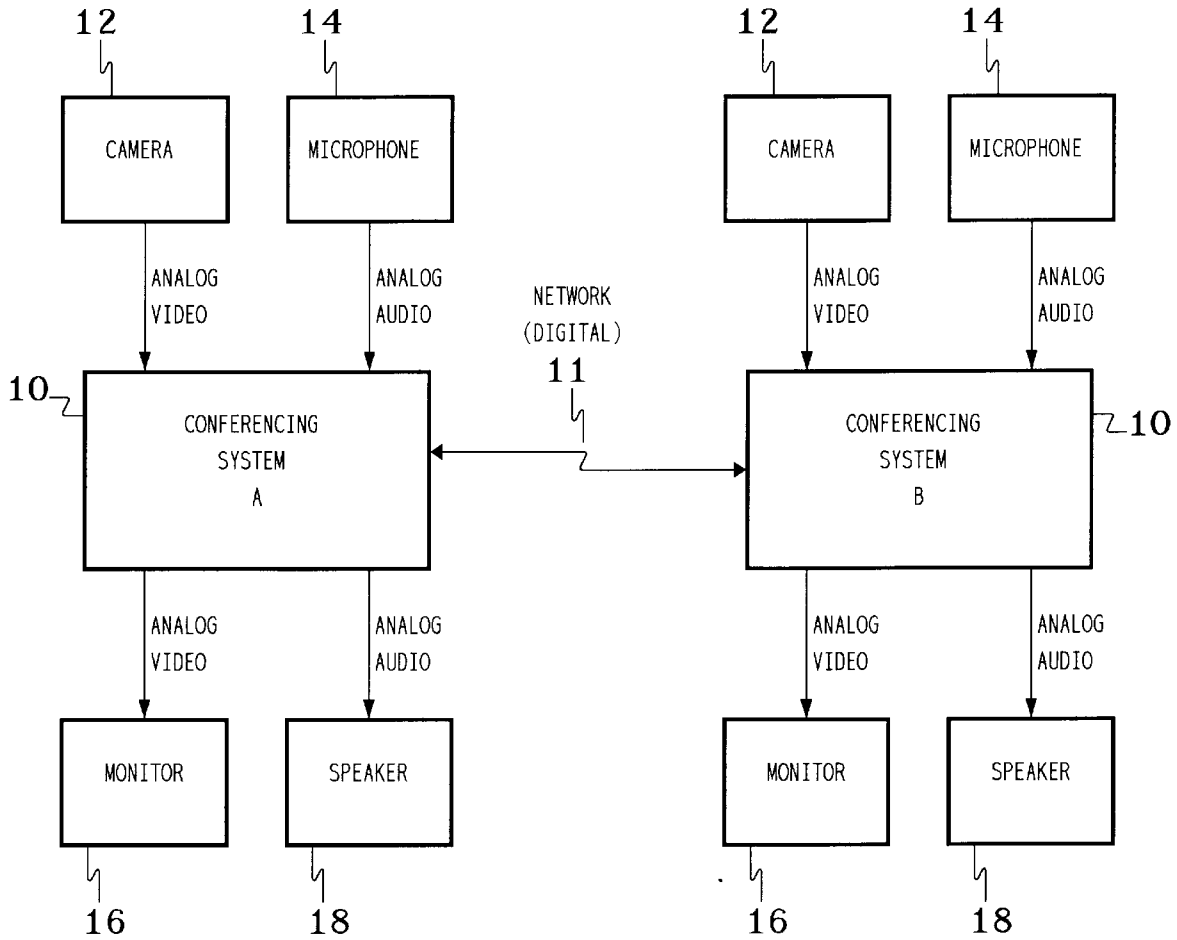
FIG. 1 is a block diagram of an audio/video conferencing system, according to a preferred embodiment of the present invention.

Referring now to FIG. 1, there is shown a block diagram representing real-time point-to-point audio/video conferencing between two personal computer (PC) based conferencing systems, according to a preferred embodiment of the present invention. Each PC system has a conferencing system 10, a camera 12, a microphone 14, a monitor 16, and a speaker 18. The conferencing systems communicate via network 11, which may be any suitable digital network, such as an integrated services digital network (ISDN), a local area network (LAN), a wide area network (WAN), an analog modem communicating over a plain old telephone service (POTS) connection, or even wireless transmission. Each conferencing system 10 receives, digitizes, and compresses the analog video signals generated by camera 12 and the analog audio signals generated by microphone 14. The compressed digital video and audio signals are transmitted to the other conferencing system via network 11, where they are decompressed and converted for play on monitor 16 and speaker 18, respectively.

Camera 12 may be any suitable camera for generating NTSC or PAL analog video signals. Microphone 14 may be any suitable microphone for generating analog audio signals. Monitor 16 may be any suitable monitor for displaying video and graphics images and is preferably a VGA monitor. Speaker 18 may be any suitable device for playing analog audio signals.

Figure 2:
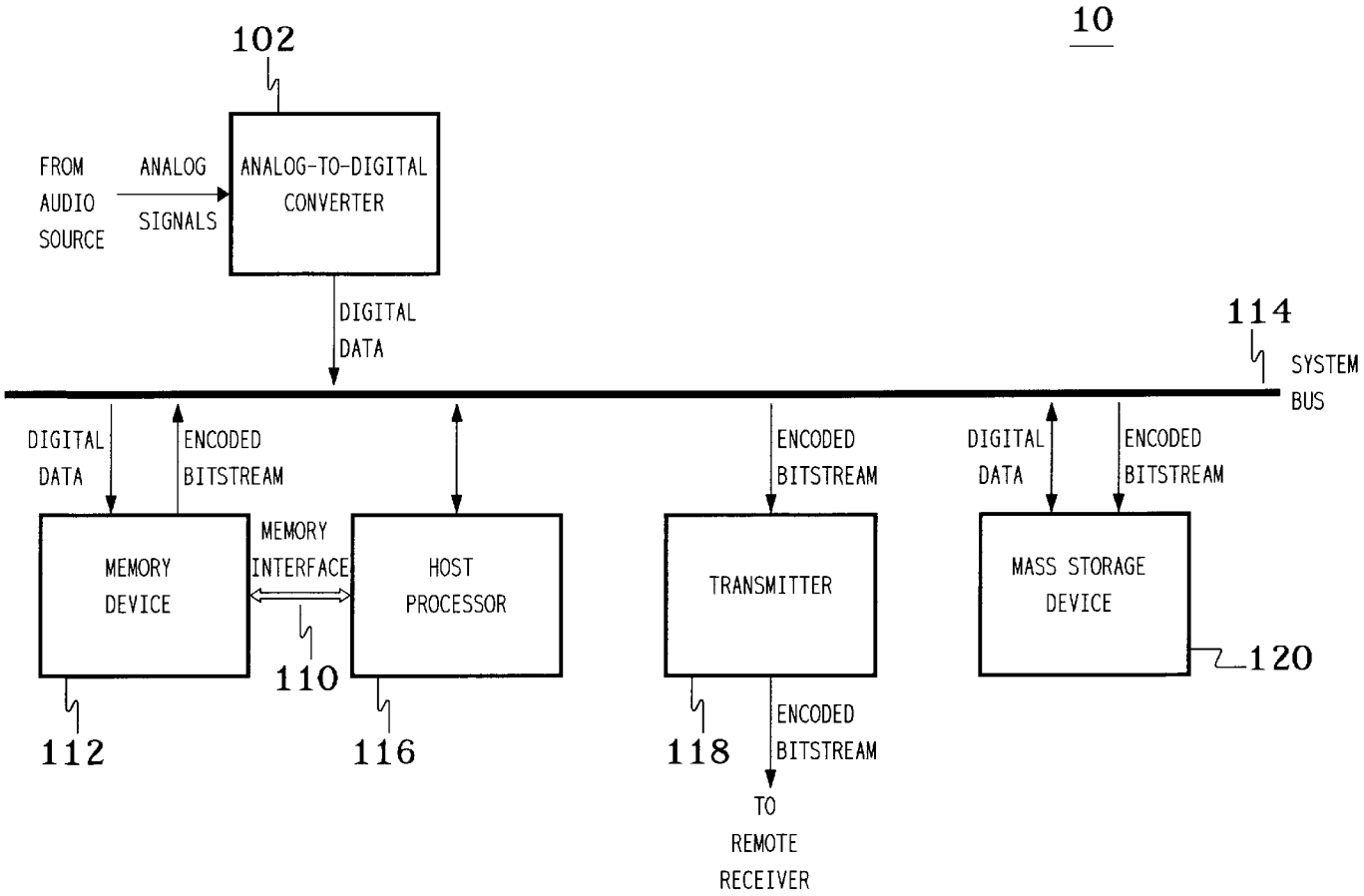
FIG. 2 is a block diagram of a conferencing system of FIG. 1 during audio encoding.

Referring now to FIG. 2, there is shown a block diagram of conferencing system 10 of FIG. 1 during audio encoding. Analog-to-digital (A/D) converter 102 of conferencing system 10 receives analog audio signals from an audio source (i.e., microphone 14 of FIG. 1). A/D converter 102 digitizes the analog audio signals and selectively stores the digital data to memory device 112 and/or mass storage device 120 via system bus 114. Those skilled in the art will understand that, for real-time encoding, the digital data are preferably stored to memory device 112, while for non-real-time encoding, the digital data are preferably stored to mass storage device 120. For non-real-time encoding, the digital data will subsequently be retrieved from mass storage device 120 and stored in memory device 112 for encode processing by host processor 116.

During encoding, host processor 116 reads the digital data from memory device 112 via high-speed memory interface 110 and generates an encoded audio bitstream that represents the digital audio data. Depending upon the particular encoding scheme implemented, host processor 116 applies a sequence of compression steps to reduce the amount of data used to represent the information in the audio stream. The resulting encoded audio bitstream is then stored to memory device 112 via memory interface 110. Host processor 116 may copy the encoded audio bitstream to mass storage device 120 for future playback and/or transmit the encoded audio bitstream to transmitter 118 for real-time transmission to a remote receiver (e.g., another conferencing system).

Figure 3:
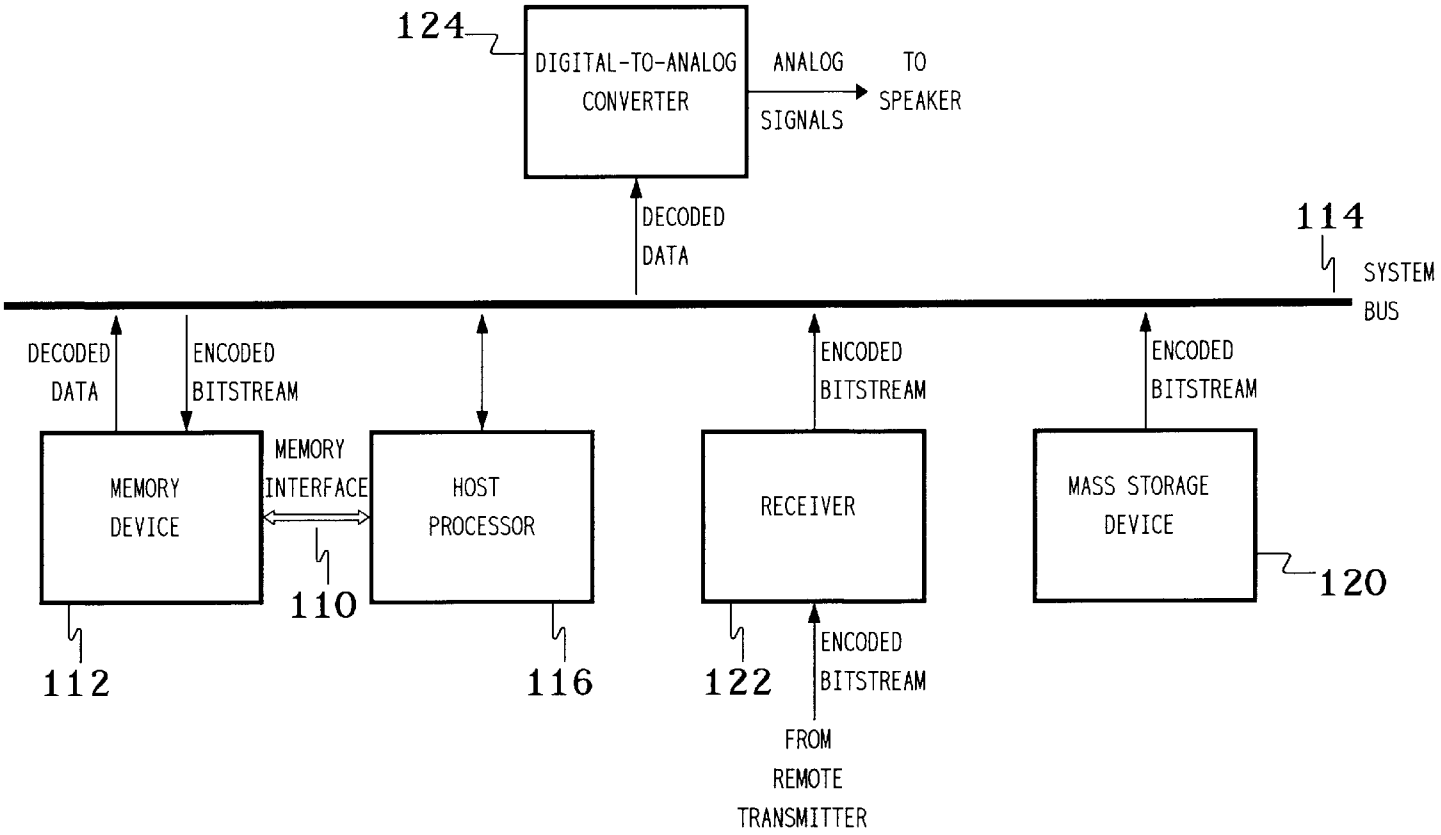
FIG. 3 is a block diagram of a conferencing system of FIG. 1 during audio decoding.

Referring now to FIG. 3, there is shown a block diagram of conferencing system 10 of FIG. 1 during audio decoding. The encoded audio bitstream is either read from mass storage device 120 or received by receiver 122 from a remote transmitter, such as transmitter 118 of FIG. 2. The encoded audio bitstream is stored to memory device 112 via system bus 114.

Host processor 116 accesses the encoded audio bitstream stored in memory device 112 via high-speed memory interface 110 and decodes the encoded audio bitstream for playback. Decoding the encoded audio bitstream involves undoing the compression processing implemented during the audio encoding of FIG. 1. Host processor 116 stores the resulting decoded audio data to memory device 112 via memory interface 110 from where the decoded audio data are transmitted to digital-to-analog (D/A) converter 124 via system bus 114. D/A converter 124 converts the digital decoded audio data to analog audio signals for transmission to and rendering by speaker 18 of FIG. 1.

Conferencing system 10 of FIGS. 1–3 is preferably a microprocessor-based PC system. In particular, A/D converter 102 may be any suitable means for digitizing analog audio signals. D/A converter 124 may be any suitable means for converting digital audio data to analog audio signals. Host processor 116 may be any suitable means for performing digital audio encoding. Host processor 116 is preferably a general-purpose microprocessor manufactured by Intel Corporation, such as an i486™, Pentium®, or Pentium® Pro™ processor. System bus 114 may be any suitable digital signal transfer device and is preferably a peripheral component interconnect (PCI) bus. Memory device 112 may be any suitable computer memory device and is preferably one or more dynamic random access memory (DRAM) devices. High-speed memory interface 110 may be any suitable means for interfacing between memory device 112 and host processor 116. Mass storage device 120 may be any suitable means for storing digital data and is preferably a computer hard drive (or alternatively a CD-ROM device for decode processing). Transmitter 118 may be any suitable means for transmitting digital data to a remote receiver. Receiver 122 may be any suitable means for receiving the digital data transmitted by transmitter 118. Those skilled in the art will understand that the encoded audio bitstream may be transmitted using any suitable means of transmission such as telephone line, RF antenna, local area network, or wide area network.

In alternative embodiments of present invention, the audio encode and/or decode processing may be assisted by a digital signal processor or other suitable component(s) to off-load processing from the host processor by performing computationally intensive operations.

Speech Coding

Figure 4:
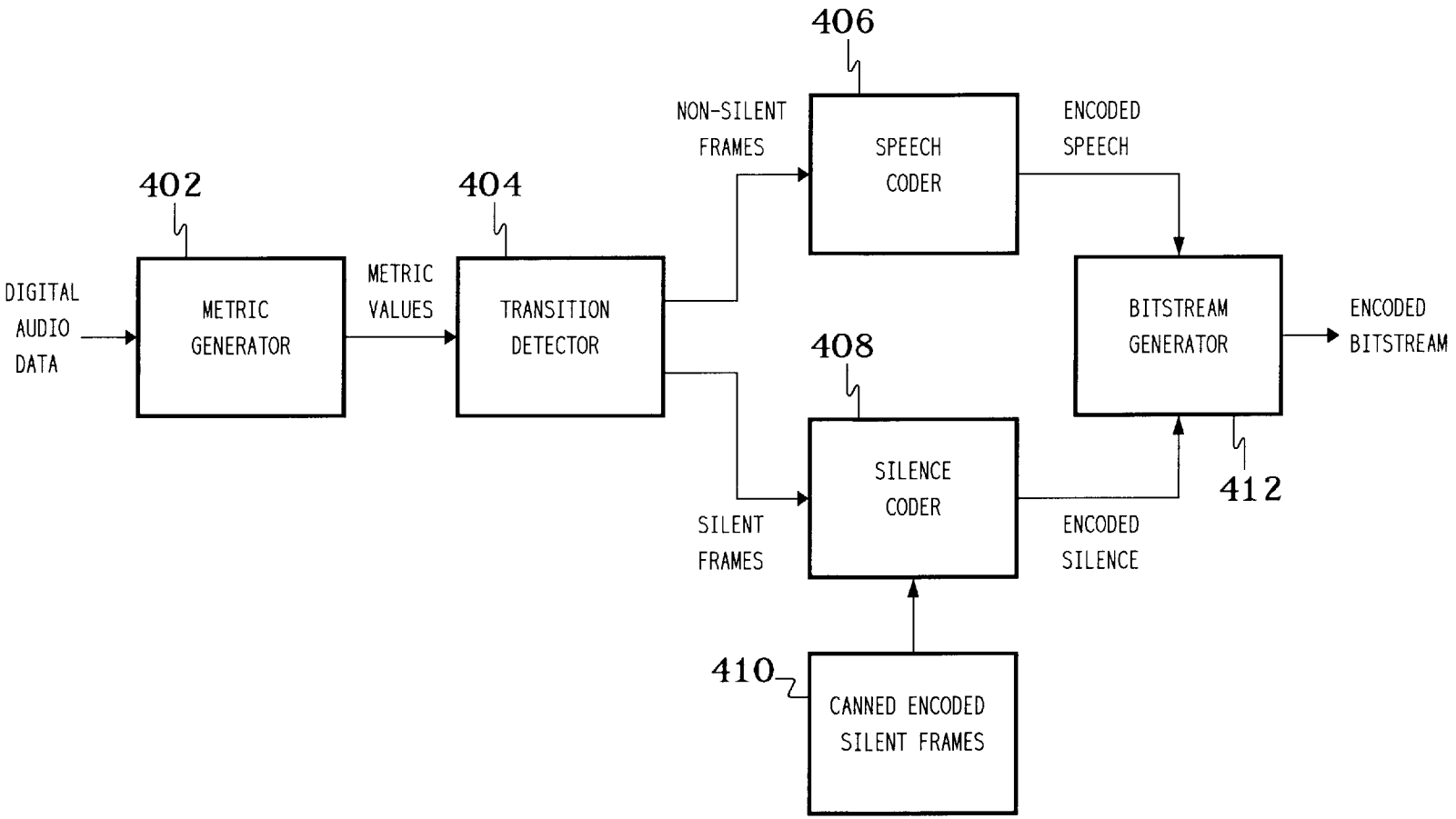
FIG. 4 is a block diagram of the audio encoding of FIG. 2 implemented by the host processor of the conferencing system of FIGS. 1–3 to compress the digital audio data into an encoded bitstream.

Referring now to FIG. 4, there is shown a block diagram of the audio encoding FIG. 2 implemented by host processor 116 of conferencing system 10 to compress the digital audio data into an encoded bitstream. As part of the audio encoding, host processor 116 distinguishes between periods of speech (i.e., non-silent frames) and periods of non-speech (i.e., silent frames) and treats them differently for purposes of generating contributions to the encoded audio bitstream.

In particular, metric generator 402 of FIG. 4 characterizes frames of digital audio data using specific metrics. Those skilled in the art will understand that a frame of audio data typically corresponds to a specific duration (e.g., 50 msec of data). The processing of metric generator 402 is described in further detail later in this specification in the section entitled "Characterizing Digital Audio Data."

Transition detector 404 applies specific logic to the metrics generated by metric generator 402 to characterize each frame as being either a non-silent frame or a silent frame. In this way, transition detector 404 identifies transitions in the audio stream from non-silent frames to silent frames and from silent frames to non-silent frames. The processing of transition detector 404 is described in further detail later in this specification in the section entitled "Characterizing Digital Audio Data."

Speech coder 406 applies a specific speech coding algorithm to those audio frames characterized as being non-silent frames to generate frames of encoded speech data. Those skilled in the art will understand that speech coder 406 may apply any suitable speech coding algorithm, such as voice coders (vocoders) utilizing linear predictive coding based compression. Examples include the European standard Groupe Special Mobile (GSM) and International Telecommunication Union (ITU) standards such as G.728.

Silence coder 408 encodes those frames identified by transition detector 404 as being silent frames. Rather than encoding the actual digital audio signals corresponding to each silent frame, silence coder 408 selects (preferably randomly) from a set of stored, precomputed (i.e., canned) encoded frames 410 corresponding to typical silent periods. A canned encoded frame is not just a flag in the bitstream to indicate that the frame is a silent frame. Rather, each canned encoded frame contains actual encoded data that will be decoded by the decoder during playback.

The canned encoded frames may be generated off-line from silent periods that are typical of the particular audio environment for the conferencing session. In fact, there may different sets of canned silent frames available, each set having a number of different encoded frames corresponding to the same general type of background sounds. For example, each set of canned silent frames may correspond to a different range of audio energy. The silence coder 408 may select a particular set based on the energy level of the actual silent periods (that measure being available from metric generator 402). The silence coder 408 would then randomly select canned frames from within that selected set.

Alternatively, the canned encoded frames may correspond to actual silent frames from earlier in this conferencing session (e.g., from the beginning of the session or updated periodically throughout the session).

By selecting from the precomputed encoded frames, the processing load imposed by silence coder 408 on host processor 116 is significantly less than if silence coder 408 were to encode the actual digital audio data corresponding to the silent frames. This allows host processor 116 to spend more of its processing power on other tasks, such as video compression and decompression and other computationally intense activities.

Bitstream generator 412 receives the frames of encoded speech from speech coder 406 and the canned frames of encoded silence selected by silence coder 408, and combines them into the encoded audio bitstream, which may then be stored to memory for subsequent playback and/or transmitted to a remote node for real-time playback. Since the encoded bitstream contains both encoded non-silent frames and encoded silent frames, a conferencing node implementing the audio decoding of FIG. 3 can be oblivious to the encoding of silent frames using canned data. This means that, so long as the encoded audio bitstream conforms to the appropriate bitstream syntax, a conferencing node implementing the audio encoding of the present invention (as shown in FIG. 4) can communicate with other conferencing nodes which may or may not implement the audio encoding of the present invention.

Characterizing Digital Audio Data

Figure 5:
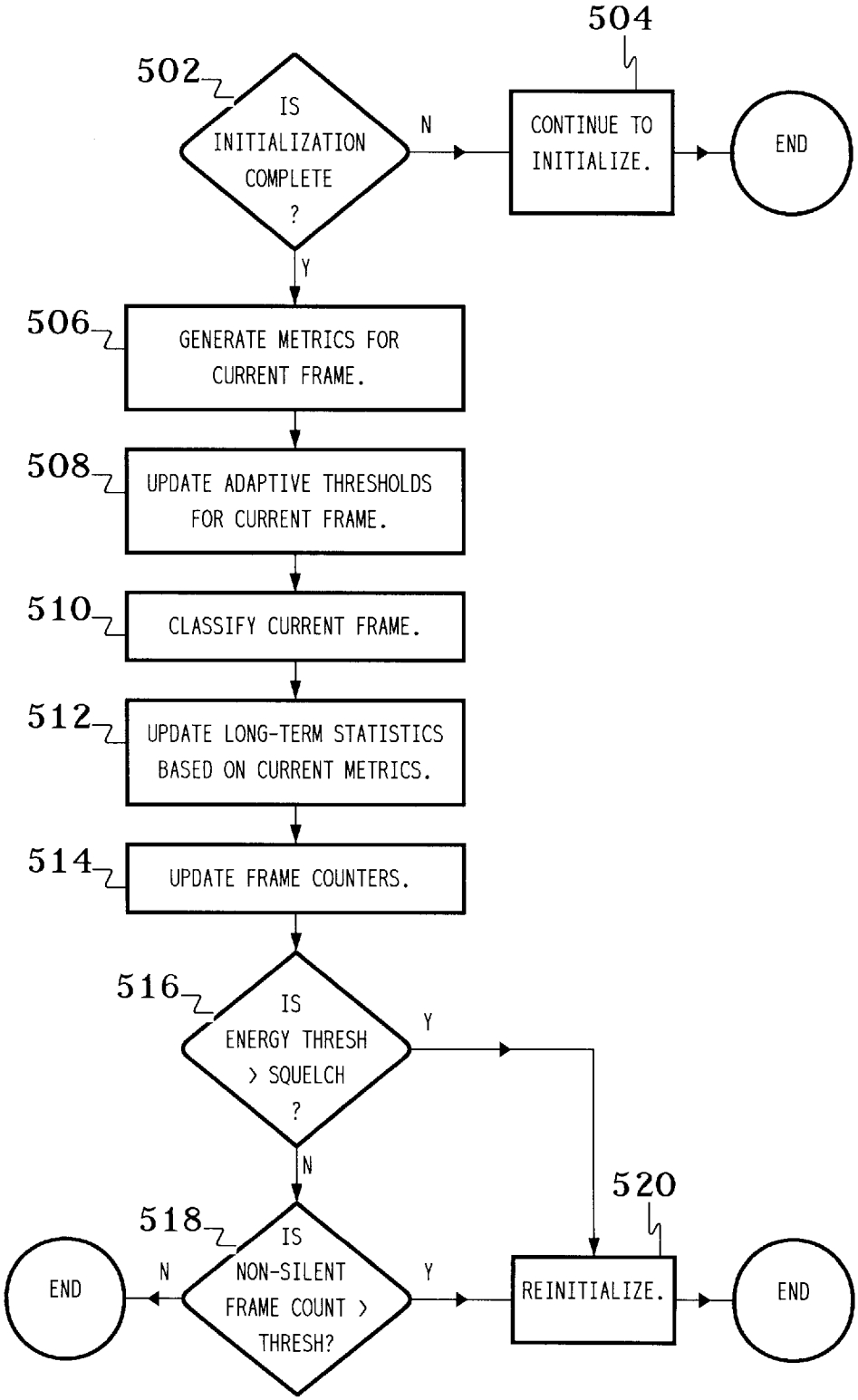
FIG. 5 is a flow diagram of the processing of the metric generator of FIG. 4 to generate metrics for the audio frames and of the transition detector of FIG. 4 to characterize the audio frames as silent or non-silent using those metrics.

Referring now to FIG. 5, there is shown a flow diagram of the processing of metric generator 402 of FIG. 4 to generate metrics for the audio frames and of transition detector 404 to characterize the audio frames as silent or non-silent using those metrics, according to a preferred embodiment of the present invention. The processing of FIG. 5 is implemented once for each frame in the audio stream. In a preferred embodiment, metric generator 402 generates three metrics for each audio frame: an energy measure, a frication measure, and a linear prediction distance measure.

In a preferred embodiment, the energy measure E is the sum of the squares of the digital values x in the frame and may be represented as follows:

$$E = \sum_{i=1}^{N} x_i^2$$

Those skilled in the art will understand that other energy measures could be used in the present invention. Alternative energy measures include, without limitation, mean sample magnitude, sum of absolute values, and sample variance. Moreover, the energy measure may be implemented with or without spectral weighting.

In a preferred embodiment, frication measure is the zero-crossing count, i.e., the number of times in a frame that the digital waveform crosses zero going either positive to negative or negative to positive. The zero-crossing count of a frame of audio samples may be computed with the following pseudo-code:

```
for(i = 0, i<frame_size−1; i++) S[i] = samples[i] * samples[i+1];
for(i = 0; i<frame_size−1; i++)
    if (S[i]<0) Zc_count++;
return(Zc_count).
```

Those skilled in the art will understand that a frication measure is one that characterizes the fricative nature of the audio data. As such, it will be understood that other frication measures could be used in the present invention. Alternative frication measures include, without limitation, the number of zero crossings limited to the positive direction, the number of zero crossing limited to the negative direction, and various frequency domain measures based on spectral analysis, such as the fast fourier transform (FFT).

In a preferred embodiment, the linear prediction distance measure measures the behavior of the first linear predictor produced as a result of linear predictive coefficient (LPC) analysis, used in standard speech compression algorithms. The first linear predictor is the term $\alpha_1$ in the following expression:

$$A(z) = 1 + \sum_{i=1}^{p} a_i z^{-i}$$

where p is the order of the prediction filter. The optimal prediction of $y_n$ given p previous values is given as follows:

$$y_n = -\sum_{i=1}^{p} a_i y_{n-i}$$

Many methods exist for obtaining the values of the coefficients $\alpha_1$ in the above expression. Levinson's method is currently popular because of its efficiency. See, e.g., J. Makhoul, "Linear Prediction: A Tutorial Review," *Proceedings of the IEEE,* Vol. 63, p. 56 (1975). Those skilled in the art will understand that other linear prediction distance measures could be used in the present invention. Alternative distance measures producing information similar to that produced by the first linear predictor include, without limitation, autocorrelation coefficients and reflection coefficients.

Those skilled in the art will understand that these three measures of energy, frication, and linear prediction distance are essentially steady for typical silence consisting of fairly uniform background noises. The first linear predictor typically fluctuates during silent periods without settling. In general, the first linear predictor behaves differently during silent periods from during non-silent periods.

The following terms and equations will be referred to in the subsequent detailed description of the preferred processing of metric generator 402 and transition detector 404 of FIG. 4:

Energy Terms:

| | |
|---|---|
| $E_i$ | Energy of the ith frame |
| $E_u$ | Mean energy |
| $E_{us}$ | Mean energy of silent frames |
| $E_{us()}$ | Initial mean energy of silent frames |
| $E_{un}$ | Mean energy of non-silent frames |
| $D_{Ei}$ | Energy deviation of ith frame |
| $MD_{Es}$ | Mean deviation of silent frame energy |
| $MD_{En}$ | Mean deviation of non-silent frame energy |
| $TE_{s-n}$ | Energy threshold for silent frame to non-silent frame transition |
| $TE_{n-s}$ | Energy threshold for non-silent frame to silent frame transition |

Zero-Crossing Count Terms:

| | |
|---|---|
| $Z_i$ | Zero-crossing count of the ith frame |
| $Z_u$ | Mean value of zero-crossing count |
| $Z_{us}$ | Mean zero-crossing count of silent frames |
| $D_{Zi}$ | Zero-crossing count deviation of ith frame |
| $MD_Z$ | Mean deviation of silent frame zero-crossing count |
| $TZ_{s-n}$ | Zero-crossing threshold for silent frame to non-silent frame transition |
| TZ | Zero-crossing threshold for non-silent frame to silent frame transition |

First Linear Predictor Terms:

| | |
|---|---|
| $A_i$ | First linear computed for the ith frame |
| $A_u$ | Mean value of first linear predictor |
| $A_{us}$ | Mean value of first linear predictor for silent frames |
| $D_{Ai}$ | First linear predictor deviation of ith frame |
| $MD_A$ | Mean deviation of silent frame first linear predictor |
| $TA_{s-n}$ | First linear predictor threshold for silent frame to non-silent frame transition |
| $TA_{n-s}$ | First linear predictor threshold for non-silent frame to silent frame transition |

-continued

| Energy Tau Terms: | |
|---|---|
| $\tau$ | Energy tau (= silent_frame_energy − non_silent_frame_energy) |
| $\tau_u$ | Mean value of energy tau |
| $MD_\tau$ | Mean deviation of energy tau |

Statistical Equations

Arithmetic mean—the arithmetic mean value of x is given by:

$$x_u = \frac{1}{N} \sum_{i=1}^{N} x_i$$

Deviation—deviation of the ith sample of x is defined as:

$$D_{xi} = |x_i - x_u|$$

where | . . . | denotes absolute value and $x^u$ is the mean value of x.

Mean deviation—the mean deviation of x is given by:

$$MD_x = \frac{1}{N} \sum_{i=1}^{N} |x_i - x_u|$$

Before external reporting of frame classification is enabled, an initializing sequence is executed. Thus, until initialization is complete (step 502 of FIG. 5), initialization continues (step 504). The initialization module executes a crude frame classification internally, but no classification decisions are produced externally until initialization is complete.

The first part of the initialization sequence loads the current values of frame energy, zero-crossing count, and first linear predictor into arrays. There are two sets of arrays; one set for storing silent-frame history and one set for storing non-silent-frame history. Each set has three arrays; each array containing N previously calculated values for one of the three metrics. During this period, the following crude silent-frame/non-silent-frame classification based only on energy is used to decide which of the two sets of arrays (i.e., silent or non-silent) the current frame parameters will be loaded into:

```
if (E_i <= E_us) or (D_Ei < TE_n-s)
{
    current_frame_class = SILENT;
    store E_i, Z_i, and A_i into array_silent;
    update silent frame statistics
}
else
{
    current_frame_class = NON-SILENT;
    store E_i, Z_i, and A_i into array_non-silent;
    update non-silent frame statistics
}
```

The mean energy of silent frames, $E_{us}$, is initialized to a value ($E_{us0}$) representing typical background energy for a silent frame plus a small offset. Thus, the very first frame is declared silent if $E_i <= E_{us0}$.

The process of loading history arrays proceeds for a pre-determined number of frames, until the silence statistics array is likely to be filled with values.

The second part of the initialization sequence computes the mean energy of silent frames, and the mean energy of non-silent frames. A separate array stores statistics on the past values of the energy tau difference given by:

$$\tau = |E_{us} - E_{un}|$$

The initialization sequence terminates when the mean deviation of energy tau, $MD_\tau$, drops below a non-adaptive threshold, $T_{stop\text{-}\tau}$. The logic used for halting initialization and enabling silence detection is:

```
if ((MD_τ, < T_stop-τ) and (init_frame_count > MINFRAMECOUNT))
{
    exit_initialization = TRUE;
    if ((τ_u > MINTAUMEAN) and (E_us + MD_Es < SQUELCH)){
        classification_enable = TRUE;
    }
}
else if (init_frame_count > MAXFRAMECOUNT)
{
    exit_initialize = TRUE;
    classification_enable = FALSE;
}
```

Initialization terminates if the mean value of the deviation of the difference between mean silent-frame and non-silent-frame energies is less than some fixed threshold, and some minimum amount of time (measured in units of frames) has passed.

Classification is enabled if the mean value of $\tau$ exceeds some minimum value, and the sum of the means silent frame energy and the mean energy deviation is less than a specified energy squelch value. The energy squelch is a constant that establishes the maximum allowable value of the mean energy of the frames classified as silent. By adjusting SQUELCH, silent frame classification may be disabled in environments with large ambient background levels by setting a low SQUELCH level.

If initialization halts and classification is enabled, the array containing values corresponding to lowest mean energy is designated the array_silent. Only the silent frame statistics are updated after initialization has terminated.

Initialization also terminates if some maximum allowable amount of time has passed without $MD_\tau$ dropping beneath the pre-set threshold.

In either case, if classification is not enabled upon termination of the initialization sequence, initialization begins anew upon receipt of the next frame.

If initialization is complete (step 502), then processing continues to step 506 with the generation of the three metrics for the current frame and the generation of the parameters that serve as input into the frame classifier. The deviations of the current frame energy, zero-crossing count, and first linear predictor value are computed. Deviation of the ith sample of x is defined above. Deviations of the ith samples of the three parameters used by the classifier are given by the following equations:

$$D_{Ei} = |E_i - E_{us}|$$

$$D_{Zi} = |Z_i - Z_{us}|$$

$$D_{Ai} = |A_i - A_{us}|$$

Mean values of frame energy, zero-crossing count, and first linear predictor value are computed using values computed for previous N frames. The arithmetic mean value may be employed as described above. N may be altered to adjust the sensitivity of the adaptive classifier. Larger values of N cause the classifier to react more slowly to changes in the ambient background conditions. Smaller values cause the classifier to respond more rapidly to changes in the ambient background.

Adaptive threshold values used in the classifier are then updated (step 508). These adaptive thresholds are linear functions of the mean deviations of each of the three classification parameters. For each of the three classification parameters, two new threshold values are computed for every frame. One threshold is computed for detecting the silent-frame-to-non-silent-frame transition, and another for detecting the non-silent-frame-to-silent-frame transition. If the previous frame was classified silent, the current frame is tested against the silent-frame-to-non-silent-frame transition threshold values. Similarly, if the previous frame was classified non-silent, the current frame is tested against the non-silent-frame-to-silent-frame transition threshold values. In this manner, the criteria defining the silent-to-non-silent transition may differ from the criteria for the non-silent-to-silent transition. This is done to take advantage of knowledge of typical speech waveform behavior. For example, it is known that energy levels at the beginning of a voiced utterance are generally larger than at the end of a voiced utterance.

The silent-frame-to-non-silent-frame transition thresholds are given by:

$$TE_{s-n}=E_{s-n}+MD_E$$

$$TZ_{s-n}=Z_{s-n}*MD_Z$$

$$TA_{s-n}=A_{s-n}*MD_A$$

where $E_{s-n}$, $Z_{s-n}$, and $A_{s-n}$ are constants that may be adjusted to alter the sensitivity of the classifier to instantaneous changes in frame energy, zero-crossing count, and first linear predictor. Since energy is preferably computed in dB, the energy constant is added rather than multiplied.

The non-silent-frame-to-silent-frame transition thresholds are calculated by similar expressions:

$$TE_{n-s}=E_{n-s}+MD_E$$

$$TZ_{n-s}=Z_{n-s}*MD_Z$$

$$TA_{n-s}=A_{n-s}*MD_A$$

Note that the magnitudes of the two sets of transition thresholds differ by the sensitivity constants.

Transition detector 404 implements the logic that classifies the current frame of audio samples as speech (non-silent) or background (silent) (step 510). The space spanned by the classifier is not exhaustive. It is possible that the parameters calculated for the current frame will not satisfy the criteria for either silence or non-silence. In this case, the classifier output will default to the class of the previous audio frame.

Figure 6:
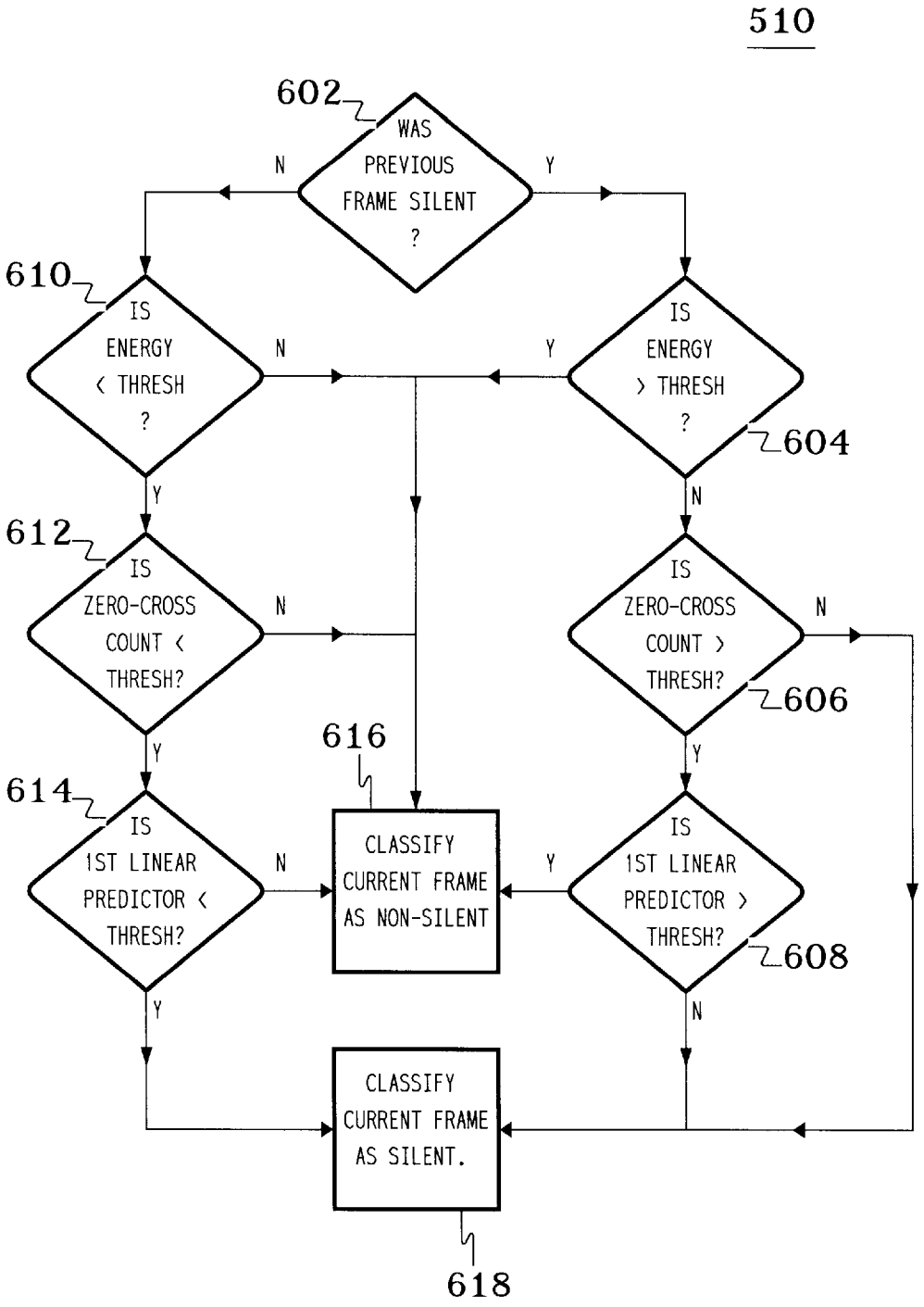
FIG. 6 is a flow diagram of the processing implemented by the transition detector of FIG. 4 to classify the current frame as being either a silent frame or a non-silent frame.

Referring now to FIG. 6, there is shown a flow diagram of the processing implemented by transition detector 404 of FIG. 4 to classify the current frame as being either a silent frame or a non-silent frame, according to a preferred embodiment of the present invention. Pseudo-code for the classification processing is as follows:

```
\\ Silent to non-silent transition classification
if(previous_frame_class == SILENT)    \\ Step 602 of FIG. 6.
{
    \\ Energy criteria for non-silent frame classification:
    \\ If energy deviation of ith frame is above threshold (step 604), immediately switch from
    \\ silent to non-silent frame classification (step 616).
    if (D_Ei > TE_s-n) current_frame_class = NON-SILENT;
    \\ Zero-crossing/first linear predictor criteria for non-silent frame classification.
    \\ If zero-cross count deviation of ith frame is above threshold (step 606) and
    \\ if first linear predictor is above threshold (step 608), then allow switch to
    \\ non-silent frame classification (step 606)
    else if((D_Zi > TZ_s-n) & (D_Ai > TA_s-n)) current_frame_class = NON-SILENT;
}
\\ Non-silent to silent frame transition classification:
\\ If all three deviations are below thresholds (steps 610, 612, and 614), then switch from
\\ non-silent to silent frame classification (step 618).
else if ((D_Ei < TEn-s) & (D_Zi < TZ_n-s) & (D_Ai < TA_n-s)) current_frame_class = SILENT;
```

After the current frame has been classified, the long-term statistics are updated (step 512 of FIG. 5). In a preferred embodiment, only silent frame statistics are maintained after initialization has completed. This is due to the fact that silence is characterized by stationary low-order statistics. Speech statistics are relatively unstationary. Thus classification succeeds by detecting frames that deviate from the statistics collected for frames designated as silent. For each frame designated as silent, the stored values are updated as follows:

```
for(j=0;j<parameter_count;j++){
\\ Parameter_count = 3: energy, zero-crossing count, and first linear predictor.
    \\ Shift all three storage arrays so that array[0] = newest_value.
    for(i=0; i<array_size; i++)silent_array_param[j][i] = silent_array_param[j][i-1]
    \\ Compute arithmetic mean.
    for (i=0; i<array_size; i++)sum += silent_array_param[j][i];
    mean = sum/array_size;
    \\ Compute mean deviation.
    sum = 0.0f;
    for (i=0; i<array_size; i++) sum += abs(silent_array_param[j][i] - mean);
    meandev = sum/array_size;
}
```

After updating the long-term statistics, frame counters are updated (step 514). The frame counters indicate how many frames in a row have been classified as either silent frames or non-silent frames.

In a preferred embodiment of the present invention, the thresholds used to identify the transitions in the input frame classification are dynamically generated. That is, they are initialized at the beginning of audio processing and then adaptively updated in real time based on the actual data in the audio stream. There are specific situations (steps 516 and 518) in which the adaptive thresholds are re-initialized during the course of a conferencing session (step 520).

For example, if the adaptive energy threshold value for switching from silent to non-silent frames exceeds a specified threshold (step 516), then the initialization processing executed at the beginning of the audio encoding session is set to be re-run starting with the next audio frame (step 520).

Moreover, many conferencing systems provides the ability to turn the local contribution to the audio conference off and on at the user's discretion. In a speakerphone, this may be implemented by toggling a mute button. In a PC-based conferencing session, this may be implemented by selecting a mute option from a dialog box displayed on the monitor. Alternatively, the microphone itself may have an on/off switch. When the local audio input is muted, the audio signals will truly be equivalent to silence (i.e., all zeros).

During such a muted period, the adaptive thresholds will begin to drop to levels correspond to lower and lower audio levels. When the system is unmuted (e.g., when microphone is turned back on), all audio signals, including those corresponding to silent periods, may be interpreted by the audio encoder as non-silence. This will happen when the audio levels associated with silent periods are greater than the threshold values after an extended period of true silence. As long as all of the audio frames are interpreted as non-silence, the thresholds will not be updated and all the audio frames will continue to be encoded using the speech coder 406 of FIG. 4. The result is the inefficient explicit encoding of silent periods as non-silence. In order to avoid this situation, the present invention preferably contains logic to re-initialize the thresholds (step 520) after a specified number of consecutive frames are identified as being all non-silent frames (step 518). Since typical conversations contain intermittent periods of silence (not just silence between speakers, but also between the words of a single speaker), selecting an appropriate threshold value for the maximum number of consecutive non-silent frames before re-initializing thresholds can efficiently discriminate between reasonable periods of constant speech and anomalies like those that may occur when muting is turned on and off.

Pseudo-code for the processing of FIG. 5 is as follows:

```
if(classification_enable = FALSE)        \\ Step 502.
{
    Initialize until classification_enable = TRUE;        \\ Step 504.
}
else
{
    Perform classification of current frame;        \\ Steps 506, 508, 510, and 512.
    if(current_frame=SILENT)        \\ Step 514.
    {
        SilentFrameCount++;
        NonsilentFrameCount=0;
    }
    else
    {
        NonsilentFrameCount++;
        SilentFrameCount=0;
    }
    \\ If the adaptive threshold for switching from silent frame to non-silent frame
    \\ has risen above the pre-set SQUELCH level, re-initialization should occur on
    \\ the next frame. Re-initialization should also occur when the NonsilentFrameCount
    \\ (continuous non-silent frame count) exceeds some pre-determined number of frames
    \\ This is necessary to prevent the case that the ambient background energy jumps
    \\ suddenly (with respect to the adaptive thresholds) to a level that causes all frames,
    \\ including silent frames, to be marked non-silent. This situation may occur, for example,
    \\ when the microphone used as the speech input device is muted or switched off without
    \\ also switching off silence classification. During mute, the adaptive thresholds that
    \\ determine the silent frame to non-silent frame transition may drift to unrealistically low
    \\ levels. Even though they are characterized by relatively low energy, silent frames
    \\ received after the microphone is un-muted may be subsequently be designated non-silent.
    if ((E_us + MD_E>SQUELCH)                        \\ Step 516.
      or
    (NonsilentFrameCount>=MAXNONSILENTCOUNT))  \\ Step 518.
    {
        Reset to start-up values;
        Set classification_enable = FALSE;                \\ Step 520.
        }
}
```

In a preferred embodiment, the basic unit of time is the audio frame and processing is implemented on each frame of audio data. Depending upon the embodiment, in the claims, the term "period" may refer to a single frame or a set of consecutive frames.

The present invention can be embodied in the form of methods and apparatuses for practicing those methods. The present invention can also be embodied in the form of computer program code embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. A method for encoding audio signals, comprising the steps of:

(a) initializing a processing sequence which is used to distinguish silent periods from non-silent periods in an audio stream;

(b) performing the processing using one or more dynamically-updated measures to distinguish the silent periods from the non-silent periods;

(c) generating the dynamically-updated measures during said processing;

(d) encoding the audio stream, wherein the silent periods are encoded differently from the non-silent periods; and (e) re-initializing the processing during the encoding of the audio stream, if a non-silent period is longer than a duration threshold.

2. The method of claim 1, wherein one of the measures is an energy measure for the silent periods of the audio stream and the processing is re-initialized if the energy measure exceeds an energy threshold level.

3. The method of claim 1, wherein step (c) comprises the step of generating the measures based on only the silent periods, wherein the measures are updated dynamically with successive silent periods.

4. The method of claim 1, wherein step (b) comprises the steps of:

(1) detecting transitions in the audio stream from non-silence to silence when a first set of transition conditions based on at least one of the measures is met; and (2) detecting transitions in the audio stream from silence to non-silence when a second set of transition conditions based on at least one of the measures is met, wherein the second set of transition conditions is different from the first set of transition conditions.

5. The method of claim 4, wherein step (c) comprises the steps of:

(1) generating an adaptive energy measure for the audio stream;

(2) generating an adaptive frication measure for the audio stream; and (3) generating an adaptive linear prediction distance measure for the audio stream.

6. The method of claim 5, wherein:

the adaptive energy measure is a sum of squares of audio signals;

the adaptive frication measure is a zero-crossing measure; and the adaptive linear prediction distance measure is a first linear predictor measure.

7. The method of claim 5, wherein:

the first set of conditions comprises:

the adaptive energy measure being less than a non-silence-to-silence energy threshold level;

the adaptive frication measure being less than a non-silence-to-silence frication threshold level; and the adaptive linear prediction distance measure being less than a non-silence-to-silence linear prediction distance threshold level; and the second set of conditions comprises one of:

the adaptive energy measure being greater than a silence-to-non-silence energy threshold level; and the adaptive frication measure being greater than a silence-to-non-silence frication metric threshold level and the adaptive linear prediction distance measure being greater than a silence-to-non-silence linear prediction distance threshold level.

8. The method of claim 7, wherein:

step (c) comprises the step of generating the measures based on only the silent periods, wherein the measures are updated dynamically with successive silent periods; and the processing is re-initialized if the adaptive energy measure exceeds a re-initialization energy threshold level.

9. An apparatus for encoding audio signals, comprising:

(a) means for initializing a processing sequence which is used to distinguish silent periods from non-silent periods in an audio stream;

(b) means for performing the processing using one or more dynamically-updated to distinguish the silent periods from the non-silent periods;

(c) means for generating the dynamically-updated measures during said processing;

(d) means for encoding the audio stream, wherein the silent periods are encoded differently from the non-silent periods; and (e) means for re-initializing the processing during the encoding of the audio stream, if a non-silent period is longer than a duration threshold.

10. The apparatus of claim 9, wherein one of the measures is an energy measure for the silent periods of the audio stream and the processing is re-initialized if the energy measure exceeds an energy threshold level.

11. The apparatus of claim 9, wherein means (c) generates the measures based on only the silent periods, wherein the measures are updated dynamically with successive silent periods.

12. The apparatus of claim 9, wherein means (b):

(1) detects transitions in the audio stream from non-silence to silence when a first set of transition conditions based on at least one of the measures is met; and (2) detects transitions in the audio stream from silence to non-silence when a second set of transition conditions based on at least one of the measures is met, wherein the second set of transition conditions is different from the first set of transition conditions.

13. The apparatus of claim 12, wherein means (c):

(1) generates an adaptive energy measure for audio stream;

(2) generates an adaptive frication measure for the audio stream; and (3) generates an adaptive linear prediction distance measure for audio stream.

14. The apparatus of claim 13, wherein:

the adaptive energy measure is a sum of squares of audio signals;

the adaptive frication measure is a zero-crossing measure; and the adaptive linear prediction distance measure is a first linear predictor measure.

15. The apparatus of claim 13, wherein:

the first set of conditions comprises:

the adaptive energy measure being less than a non-silence-to-silence energy threshold level;

the adaptive frication measure being less than a non-silence-to-silence linear prediction distance threshold level; and the second set of conditions comprises one of:

the adaptive energy measure being greater than a silence-to-non-silence energy threshold level; and the adaptive frication measure being greater than a silence-to-non-silence frication metric threshold level and the adaptive linear prediction distance measure being greater than a silence-to-non-silence linear prediction distance threshold level.

16. The apparatus of claim 15, wherein:

means (c) generates the measures based on only the silent periods, wherein the measures are updated dynamically with successive silent periods; and the processing is re-initialized if the adaptive energy measure exceeds a re-initialization energy threshold level.

17. A storage medium having stored thereon a plurality of instructions for encoding audio signals, wherein the plurality of instructions, when executed by a processor, cause the processor to perform the steps of:

(a) initializing a processing sequence which is used to distinguish silent periods from non-silent periods in an audio stream;

(b) performing the processing using one or more dynamically-updated measures to distinguish the silent periods from the non-silent periods;

(c) generating the dynamically-updated measures during said processing;

(d) encoding the audio stream, wherein the silent periods are encoded differently from the non-silent periods; and (e) re-initializing the processing during the encoding of the audio stream, if a non-silent period is longer than a duration threshold.

18. The storage medium of claim 17, wherein one of the measures is an energy measure for the silent periods of the audio stream and the processing is re-initialized if the energy measure exceeds an energy threshold level.

19. The storage medium of claim 17, wherein step (c) comprises the step of generating the measures based on only the silent periods, wherein the measures are updated dynamically with successive silent periods.

20. The storage medium of claim 17, wherein step (b) comprises the steps of:

(1) detecting transitions in the audio stream from non-silence to silence when a first set of transition conditions based on at least one of the measures is met; and (2) detecting transitions in the audio stream from silence to non-silence when a second set of transition conditions based on at least one of the measures is met, wherein the second set of transition conditions is different from the first set of transition conditions.

21. The storage medium of claim 20, wherein step (c) comprises the steps of:

(1) generating an adaptive energy measure for the audio stream;

(2) generating an adaptive frication measure for the audio stream; and (3) generating an adaptive linear prediction distance measure for the audio stream.

22. The storage medium of claim 21, wherein:

the adaptive energy measure is a sum of squares of audio signals;

the adaptive frication measure is a zero-crossing measure; and the adaptive prediction distance measure is a first linear predictor measure.

23. The storage medium of claim 21, wherein:

the first set of conditions comprises:

the adaptive energy measure being less than a non-silence-to-silence energy threshold level;

the adaptive frication measure being less than a non-silence-to-silence frication threshold level; and the adaptive linear prediction distance measure being less than a non-silence-to-silence linear prediction distance threshold level; and the second set of conditions comprises one of:

the adaptive energy measure being greater than a silence-to-non-silence energy threshold level; and the adaptive frication measure being greater than a silence-to-non-silence frication metric threshold level and the adaptive linear prediction distance measure being greater than a silence-to-non-silence linear prediction distance threshold level.

24. The storage medium of claim 23, wherein:

step (c) comprises the step of generating the measures based on only the silent periods, wherein the measures are updated dynamically with successive silent periods; and the processing is re-initialized if the adaptive energy measure exceeds a re-initialization energy threshold level.

25. An audio processing system for encoding audio signals, comprising:

a metric generator;

a transition detector;

a speech coder;

a silence coder; and a bitstream generator, wherein:

the transition detector initializes a processing sequence which is used to distinguish silent periods from non-silent periods in an audio stream;

the transition detector performs the processing using one or more dynamically-updated measures to distinguish the silent periods from the non-silent periods the metric generator generates the one or more dynamically updated measures during the processing;

the speech coder encodes the non-silent periods;

the silence coder encodes the silent periods, wherein the silent periods are encoded differently from the non-silent periods;

the bitstream generator generates an encoded audio stream from the encoded non-silent periods and the encoded silent periods; and the transition detector re-initializes the processing during the encoding of the audio stream, if a non-silent period is longer than a duration threshold.

26. The audio processing system of claim 25, wherein one of the measures is an energy measure for the silent periods of the audio stream and the processing is re-initialized if the energy measure exceeds an energy threshold level.

27. The audio processing system of claim 25, wherein the metric generator generates the measures based on only the silent periods, wherein the measures are updated dynamically with successive silent periods.

28. The audio processing system of claim 25, wherein the transition detector:

(1) detects transitions in the audio stream from non-silence to silence when a first set of transition conditions based on at least one of the measures is met; and (2) detects transitions in the audio stream from silence to non-silence when a second set of transition conditions based on at least one of the measures is met, wherein the second set of transition conditions is different from the first set of transition conditions.

29. The audio processing system of claim 28, wherein the metric generator:

(1) generates an adaptive energy measure for the audio stream;

(2) generates an adaptive frication measure for the audio stream; and (3) generates an adaptive linear prediction distance measure for the audio stream.

30. The audio processing system of claim 29, wherein:

the adaptive energy measure is a sum of squares of audio signals;

the adaptive frication measure is a zero-crossing measure; and the adaptive linear prediction distance measure is a first linear predictor measure.

31. The audio processing system of claim 29, wherein:

the first set of conditions comprises:

the adaptive energy measure being less than a non-silence-to-silence energy threshold level;

the adaptive frication measure being less than a non-silence-to-silence frication threshold level; and the adaptive linear prediction distance measure being less than a non-silence-to-silence linear prediction distance threshold level; and the second set of conditions comprises one of:

the adaptive energy measure being greater than a silence-to-non-silence energy threshold level; and the adaptive frication measure being greater than a silence-to-non-silence frication metric threshold level and the adaptive linear prediction distance measure being greater than a silence-to-non-silence linear prediction distance threshold level.

32. The audio processing system of claim 31, wherein:

the metric generator generates the measures based on only the silent periods, wherein the measures are updated dynamically with successive silent periods; and the processing is re-initialized if the adaptive energy measure exceeds a re-initialization energy threshold level.

* * * * *